United States Patent [19]

Lorenz et al.

[11] Patent Number: 4,854,116

[45] Date of Patent: Aug. 8, 1989

[54] A SPINDLE ROTOR ADAPTED FOR USE IN A SPINDLE OF A TEXTILE THREAD PROCESSING MACHINE

[75] Inventors: Rainer Lorenz, Nettetal-Breyell; Gustav Frenzen, Willich; Ulrich Lossa, Krefeld, all of Fed. Rep. of Germany

[73] Assignee: Palitex Project Company GmbH, Krefeld, Fed. Rep. of Germany

[21] Appl. No.: 209,869

[22] Filed: Jun. 22, 1988

[30] Foreign Application Priority Data

Jun. 29, 1987 [DE] Fed. Rep. of Germany ..... 3721364

[51] Int. Cl.[4] ..... D01H 7/86; D01H 11/00; D01H 13/04; D01H 13/30

[52] U.S. Cl. ..... 57/58.84; 57/58.49; 57/58.83; 57/279; 57/304; 57/308

[58] Field of Search ..... 57/58.49, 58.55, 352, 57/58.7, 58.72, 304, 58.83, 58.86, 279, 308

[56] References Cited

U.S. PATENT DOCUMENTS

| | | | |
|---|---|---|---|
| 3,564,832 | 2/1971 | Heimes | 57/58.84 |
| 4,125,992 | 11/1978 | Kallmann | 57/58.83 |
| 4,158,282 | 6/1979 | Guerton et al. | 57/58.72 |
| 4,569,189 | 2/1986 | Frentzel-Beyme | 57/58.83 |

FOREIGN PATENT DOCUMENTS

| | | |
|---|---|---|
| 1760063 | 12/1971 | Fed. Rep. of Germany . |
| 2544643 | 4/1977 | Fed. Rep. of Germany . |
| 1280388 | 11/1961 | France . |

*Primary Examiner*—John Petrakes

*Attorney, Agent, or Firm*—Bell, Seltzer, Park & Gibson

[57] ABSTRACT

A spindle rotor is adapted (1) for use in a spindle of a textile thread processing machine, such as a two-for-one twister, in which the running thread being processed passes through an axially and radially extending thread passageway in the spindle and formed a rotating balloon around the spindle and includes means for supplying a flow of thread conditioning medium, fibrous material or other medium adapted to flow in a generally axial direction through the spindle and (2) to receive, guide and enhance the flow while performing the thread processing functions. The spindle rotor includes a hub member for rotatably mounting the spindle rotor in the machine spindle, a plurality of spaced-apart guide blades attached to the hub member and extending radially outwardly therefrom in a spoke-like manner for receiving the thread conditioning medium, and a radially extending thread passageway through the hub and one of the guide blades for receiving the running thread being processed.

8 Claims, 3 Drawing Sheets

A SPINDLE ROTOR ADAPTED FOR USE IN A SPINDLE OF A TEXTILE THREAD PROCESSING MACHINE

FIELD AND BACKGROUND OF THE INVENTION

This invention relates to a spindle rotor adapted (1) for use in a spindle of a textile thread processing machine, such as a two-for-one twister, in which the running thread being processed passes through and axially and radially extending thread passageway in the spindle and forms a rotating balloon around the spindle and includes means for supplying a flow of thread conditioning medium, fibrous material or other medium adapted to flow in a generally axial direction through the spindle and (2) to receive, guide and enhance the flow while performing the thread processing functions.

In such spindles of textile thread processing machines, the mechanisms for forming the rotating balloon of thread form obstacles for supplying of a conditioning medium into the space surrounded by the rotating balloon of thread.

In case of a two-for-one twisting spindle, the conditioning medium can be, for example, conditioned air, but also two-phase-media such as droplets suspended in air, suitable liquids or solid matter particles (paraffines) which are selected to exert particular effects onto the yarn or thread, respectively.

There are further difficulties if fibrous material is to be fed into the space surrounded by the thread balloon.

The DE-OS No. 28 09 252 (=U.S. Pat. No. 4 158 282) discloses a spindle rotor for a two-for-one twisting spindle. In the annular range of the spindle rotor which is brushed over by the rotating thread-guiding passageway, holes for assembling purposes are provided in order to avoid that the entire construction of the spindle rotor which is composed of two interspersed constructional groups, will have to be totally dismantled and reassembled again in order, for example, to carry out tending operations. The known assembly holes are not provided or adapted for the trouble-free supply of a flowing medium into the space above the spindle rotor.

DE-OS No 17 60 063 relates to a two-for-one twisting spindle comprising, below the spindle rotor, a casing which is open towards the spindle rotor. In the casing, a device for supplying a liquid or gaseous conditioning medium for the yarn is provided. In the known two-for-one twisting spindle, the conditioning medium is sprayed or blown against the bottom surface of the spindle rotor where it is taken up by the yarn which slides on said bottom surface. The known mechanism is also not adapted to supply a flowing medium into the space directly above the spindle rotor.

OBJECT AND SUMMARY OF THE INVENTION

The object of the invention is to design a spindle rotor in such away that a medium which is adapted to flow, can be easily introduced into the space which is surrounded by the thread balloon.

This object is accomplished by providing a spindle rotor having a hub member for rotatably mounting the spindle rotor in the machine spindle, a plurality of spaced-apart guide blades attached to the hub member and extending radially outwardly therefrom in a spoke-like manner for receiving the thread conditioning medium, and a radially extending thread passageway through the hub and one of the guide blades for receiving the running thread being processed.

Preferably, the guide blades comprise a wing-like profile in the manner of turbine veins. The spindle rotor also preferably further includes a rotationally symmetrical ring secured to and surrounding the outer ends of the guide blades and forming a thread storage disk, and an annular rotation plate secured to and extending outwardly from the ring member to aid in forming the rotating ballon of thread.

This spindle rotor is specifically adapted for use in a spindle of a two-for-one twister textile thread processing machine having a driven rotating shaft and a non-rotating shaft mounted on and above the rotating shaft in axial alignment therewith. A supply of thread is carried on the non-rotating shaft and a protective cage is carried by the non-rotating shaft and surrounds the thread supply. A yarn passageway extends axially through the non-rotating shaft and partially through the rotating shaft and extends radially out of the rotating shaft for receiving a running thread therethrough from the thread supply. This radially extending thread passageway communicates with the radially extending thread passageway through the hub and one of the guide blades in the spindle rotor so that the running thread will pass therethrough and form the rotating balloon of running thread around the protective cage. The means for supplying a flow of thread conditioning medium preferably includes a housing mounted below the spindle rotor for receiving a flow of thread conditioning medium and having an open upper side facing the bottom of the rotor so that the rotor receives guides and enhances the flow of thread conditioning medium to flow into the protective cage. The protective cage preferably includes apertures in a bottom thereof facing the top of the rotor for passage of the flow of thread conditioning medium.

BRIEF DESCRIPTION OF THE DRAWINGS

The invention is described in detail and shown in the drawings.

DESCRIPTION OF PREFERRED EMBODIMENT OF THE INVENTION

Figure 1:
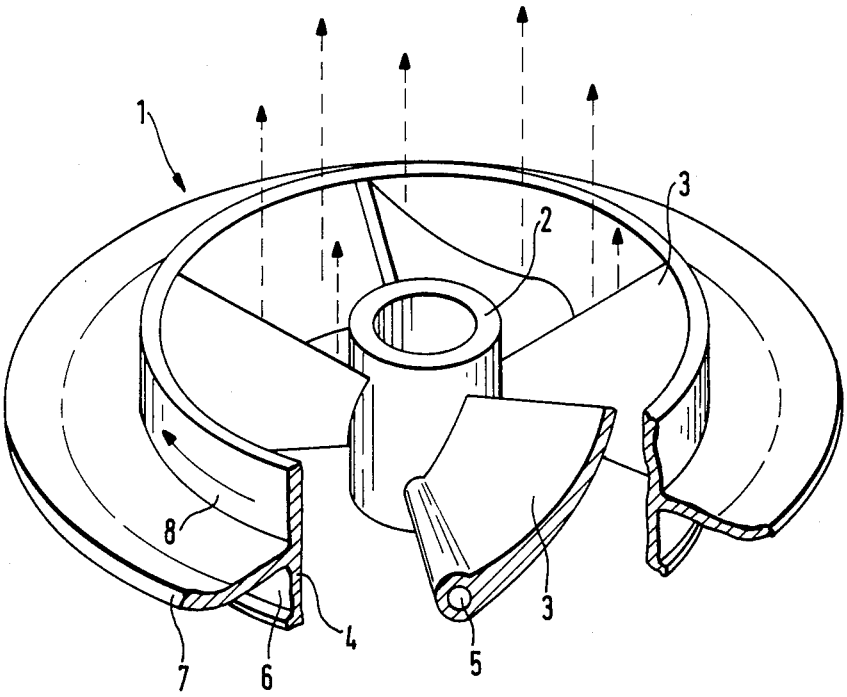
FIG. 1 is a partial section of the spindle rotor in perspective view.

The spindle rotor as shown in FIG. 1 comprises a hub member 2 and, attached thereto, a number of guide blades 3 which are surrounded by a ring member 4. At least one of the guide blades 3 is provided with a substantially radially directed thread-guiding passageway 5 which, towards the outside, passes through the lower edge 6 of ring member 4 which edge 6, in connection with a two-for-one twisting spindle, is normally called a thread storage disc. This lower edge (thread storage disc 6) is followed by a radially outwardly directed annular rotational plate 7. Additionally, ring member 4 has a ring portion 8 protuding upwards from the rotational plate 7.

The vanes or guide blades 3 are preferably formed in the manner of turbine vanes so that a sufficient flow is obtained in axial direction through the spindle rotor between the hub member 2 and the ring member 4 thereof.

Figure 2:
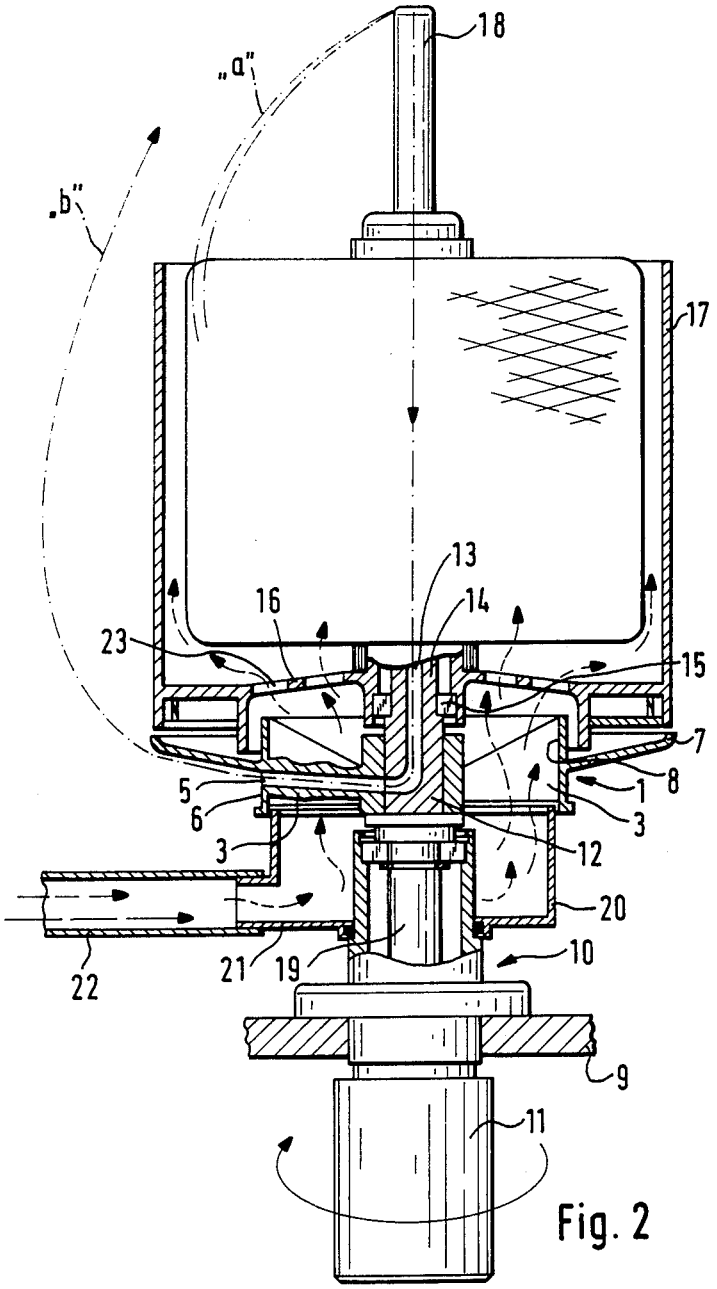
FIG. 2 is an axial section through the spindle rotor in connection with a two-for-one twisting spindle shown in a partially sectional side view.

FIG. 2 shows the spindle rotor 1 according to the invention in connection with a two-for-one twisting spindle.

According to FIG. 2, a spindle 10 is mounted in a spindle bar 9. For example, the spindle can be driven through a whorl 11 by a tangential belt (not shown). On a shaft portion 12 which is rigidly connected with whorl 11, the spindle rotor 1 is positively secured by sliding or forcing the hub member 2 onto the shaft portion 12 by pressure.

The inner end of thread-guiding passageway 5 is connected with the lower end of thread passageway 13 by means of an arcuate passageway portion. Shaft portion 12 is connected to hollow spindle shaft 14 which follows in upward direction. The bottom 16 together with the barrel-like protective cage 17 is slipped onto the shaft portion 12 or the hollow spindle shaft 14, respectively, by means of bearings 15. The jacket of the protective cage is provided with magnets (not shown) which are opposed at a distance by holding magnets (not shown). The holding magnets are arranged outside of the protective cage comprising the bottom and the jacket and the hold the latter back against rotation. The bottom 16 of the protective cage is provided with apertures 23.

As usual, a yarn "a" runs into the yarn inlet tube 18 from above and moves through the thread passageway 13 of the hollow spindle shaft 14 into the thread-guiding passageway 5 of spindle rotor 1, and then radially outwardly in order to slide along a portion of rotational plate 7 before being deflected again in upward direction. Under the formation of a thread balloon "b", the yarn is moved upwards and, after passing a thread eyelet (not shown), is then conveyed to a winding apparatus in order to be wound up.

Figure 3:
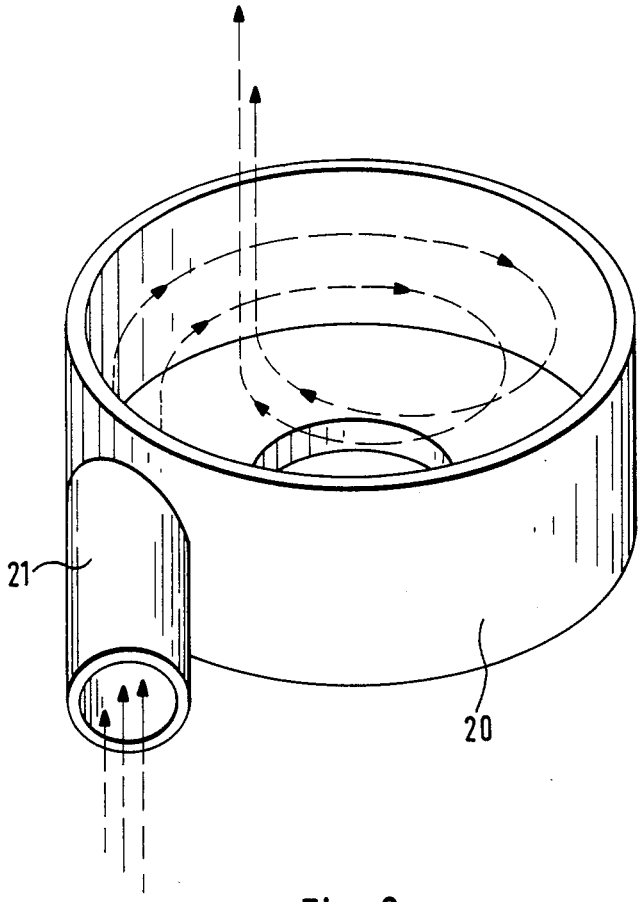
FIG. 3 is a perspective view of an additional part of the spindle rotor for supplying a medium adapted of flowing.

Below the spindle rotor 1, a rotationally symmetrical casing 20 is slipped onto the spindle shank 19, whereby the casing 20 opens in upward direction and is adapted to be supplied with a flowing medium through a connecting stud 21 and a connecting tube 22. The upper edge of casing 20 which is essentially shown in FIG. 3, is inserted into the hollow space formed by the lower edge 6 of ring member 4, in such a way that the medium which flows into the casing 20, can flow as easily as possible through the spindle rotor 1 and through the perforated bottom 16 of the protective cage, into the interior of the latter. The guide blades 3 can be formed and pitched in such a way that, upon rotation of the spindle rotor, the guide blades act as a vacuum for conveying a medium flow corresponding to the arrows in FIG. 2.

In connection with the two-for-one twisting spindle, the medium flow can be a flow of conditioned air, especially moistened air, but also an oil mist or paraffine-smoke containing air. Use can also be made by another conditioning medium for solving the problem of improving or optimizing the thread characteristics in a particular way. The conditioning medium can likewise be supplied to the casing 20 by means of a blower or the like.

It is particularly significant and useful if, by means of the rotating spindle rotor, fibrous material is to be blown into the space enclosed by thread balloon "b".

I claim:

1. A spindle rotor adapted (1) for use in a spindle of a textile thread processing machine, such as a two-for-one twister, in which the running thread being processed passes through an axially and radially extending thread passageway in the spindle anf forms a rotating balloon around the spindle and includes means for supplying a flow of thread conditioning medium, fibrous material or other medium adapted to flow in a generally axial direction through the spindle and (2) to receive, guide and enhance the flow while performing the thread processing functions; said spindle rotor comprising a hub member for rotatably mounting said spindle rotor in the machine spindle, a plurality of spaced-apart guide blades attached to said hub member and extending radially outwardly therefrom in a spoke-like manner for receiving the thread conditioning medium, and a radially extending thread passageway through said hub and one of said pulse blades for receiving the running thread being processed.

2. A spindle rotor, as set forth in claim 1, in which each of said guide blades comprises a wing-like profile in the manner of turbine vanes.

3. A spindle rotor, as set forth in claim 1 or 2, further comprising a rotationally symmetrical ring member secured to and surrounding the outer ends of said guide blades and forming a thread storage disc, and an annular rotation plate secured to and extending outwardly from said ring member.

4. In a spidle of two-for-one twister textile thread processing machine having a driven rotating shaft, a non-rotating shaft mounted on and above said rotating shaft in axial alignment therewith, a supply of thread carried on said non-rotating shaft, a protective cage carried by said non-rotating shaft and surrounding said thread supply, and a yarn passageway extending axially through said non-rotating shaft and partially through said rotating shaft and extending radially out of said rotating shaft for receiving a running thread therethrough from said thread supply; the combination therewith of:

a spindle rotor comprising a hub member mounted on said rotating shaft for rotation therewith below said protective cage, a plurality of spaced-apart guide blades attached to said hub member and extending radially outwardly in a spoke-like manner, and a radially extending thread passageway through said hub and one of said guide blades and communicating with said radially extending thread passage in said rotating shaft for receiving the running thread therethrough and for forming a rotating balloon of the running thread around said protective cage; and means mounted on said spindle below said rotor for supplying a flow of thread conditioning medium in a generally upward axial direction for being received, guided and enhanced by said guide blades of said spindle rotor to flow into said protective cage.

5. In a two-for-one twister textile thread processing machine, as set forth in claim 4, in which said means for supplying a flow of thread conditioning medium includes a housing mounted below said rotor for receiving a flow of thread conditioning medium and having an open upper side facing the bottom of said rotor.

6. In a two-for-one twister textile thread processing machine, as set forth in claim 5, in which said protective cage includes apertures in a bottom thereof facing the top of said rotor for passage of the flow of thread conditioning medium.

7. In a two-for-one twister textile thread processing machine, as set forth in claim 4, 5 or 6, in which said spindle rotor further comprises a rotationally symmetrical ring member secured to and surrounding the outer ends of said guide blades and forming a thread storage disk, and an annular rotation plate secured to and extending outwardly from said ring member to aid in forming the rotating balloon of thread.

8. In a two-for-one twister textile thread processing machine, as set forth in claim 7, in which each of said guide blades comprises a wing-like profile in the manner of turbine veins.

* * * * *